US009115927B2

(12) United States Patent
Rackley et al.

(10) Patent No.: US 9,115,927 B2
(45) Date of Patent: Aug. 25, 2015

(54) CRISPER DRAWERS WITH ROLLERS AND RAMP

(75) Inventors: Timothy Bryan Rackley, Easley, SC (US); Bryan A. Collins, Williamston, SC (US); Paul H. Kelly, Anderson, SC (US)

(73) Assignee: ELECTROLUX HOME PRODUCTS, INC., Cleveland, OH (US)

( * ) Notice: Subject to any disclaimer, the term of this patent is extended or adjusted under 35 U.S.C. 154(b) by 402 days.

(21) Appl. No.: 13/097,621

(22) Filed: Apr. 29, 2011

(65) Prior Publication Data

US 2012/0273504 A1 Nov. 1, 2012

(51) Int. Cl.
*F25D 25/02* (2006.01)

(52) U.S. Cl.
CPC ..... *F25D 25/025* (2013.01); *A47B 2210/0043* (2013.01)

(58) Field of Classification Search
CPC ..... A47B 88/06; A47B 88/14; A47B 88/047; A47B 2210/091; A47B 2210/0021; A47B 2210/0043; A47B 2210/0045; A47B 2210/0059; A47B 2210/0064; F25D 25/021; F25D 25/025
USPC ..... 312/402, 404, 330.1, 333, 334.7, 312/334.44, 334.1, 334.45–334.47
See application file for complete search history.

(56) References Cited

U.S. PATENT DOCUMENTS

| | | | | | |
|---|---|---|---|---|---|
| 843,194 | A | * | 2/1907 | Coolbaugh | 312/294 |
| 2,755,158 | A | * | 7/1956 | Davidson | 312/404 |
| 2,966,388 | A | * | 12/1960 | D Olive et al. | 312/333 |
| 3,026,149 | A | * | 3/1962 | Ruhnke | 384/19 |
| 3,104,142 | A | * | 9/1963 | Geren et al. | 312/333 |
| 3,243,247 | A | * | 3/1966 | Knape | 312/333 |
| 3,266,858 | A | * | 8/1966 | Klotz | 312/270.3 |
| 3,519,319 | A | * | 7/1970 | Taylor | 312/246 |
| 3,722,975 | A | * | 3/1973 | Taylor | 312/334.44 |
| 3,973,814 | A | * | 8/1976 | Entrikin | 312/333 |
| 4,058,920 | A | * | 11/1977 | Moltrecht | 40/336 |
| 4,564,248 | A | * | 1/1986 | Grass | 384/19 |
| 4,936,641 | A | * | 6/1990 | Bussan et al. | 312/408 |
| 5,040,856 | A | | 8/1991 | Wilkins | |
| 5,076,712 | A | * | 12/1991 | Salice | 384/19 |

(Continued)

FOREIGN PATENT DOCUMENTS

| | | |
|---|---|---|
| CN | 101963433 A | 2/2011 |
| DE | 27 01 712 A1 | 7/1978 |

OTHER PUBLICATIONS

International Search Report issued in Application No. PCT/US2012/033025 dated Mar. 6, 2013.

(Continued)

*Primary Examiner* — Daniel J Troy
*Assistant Examiner* — Ryan A Doyle
(74) *Attorney, Agent, or Firm* — Pearne & Gordon LLP

(57) ABSTRACT

A crisper drawer for a refrigerator is provided. The crisper drawer includes a crisper pan and a shelf. The crisper pan has a pair of pan rolling surfaces with a ramp portion. The shelf is fixed to the storage compartment, and has a pair of fixed shelf rollers. Each of the pair of the fixed shelf rollers rolls on each of the pan rolling surfaces, and each of the pair of the pan rear rollers rolls on each of the shelf rolling surfaces. As the user pushes the crisper drawer closed, both the shelf rollers and the pan rollers roll on the rolling surfaces. When the shelf rollers reach a ramp portion, the crisper drawer is self-closed without the user's pushing operation.

18 Claims, 9 Drawing Sheets

(56) References Cited

U.S. PATENT DOCUMENTS

| | | | | |
|---|---|---|---|---|
| RE34,108 | E * | 10/1992 | Grass | 384/19 |
| 5,302,030 | A | 4/1994 | Buie | |
| 5,490,724 | A * | 2/1996 | Domenig | 312/334.45 |
| 5,496,105 | A * | 3/1996 | Czarnecky et al. | 312/334.4 |
| 5,524,981 | A * | 6/1996 | Herrmann et al. | 312/408 |
| 5,785,400 | A * | 7/1998 | Grieser et al. | 312/334.12 |
| 5,820,239 | A * | 10/1998 | Christenson et al. | 312/334.23 |
| 5,918,959 | A | 7/1999 | Lee | |
| 6,170,276 | B1 | 1/2001 | Mandel | |
| 6,223,553 | B1 | 5/2001 | Albert | |
| 6,343,477 | B1 | 2/2002 | Mandel | |
| 6,463,752 | B2 | 10/2002 | Mandel | |
| 6,612,116 | B2 | 9/2003 | Fu | |
| 2003/0030353 | A1* | 2/2003 | Remmers | 312/334.7 |
| 2005/0156494 | A1* | 7/2005 | Bergmann et al. | 312/404 |
| 2005/0280341 | A1 | 12/2005 | Vardon | |
| 2007/0222348 | A1* | 9/2007 | Kobayashi | 312/334.6 |
| 2008/0093320 | A1* | 4/2008 | Glover | 211/126.12 |
| 2008/0202145 | A1* | 8/2008 | Lim et al. | 62/382 |
| 2008/0202146 | A1* | 8/2008 | Lim et al. | 62/382 |
| 2010/0066228 | A1* | 3/2010 | Park | 312/408 |
| 2011/0018414 | A1* | 1/2011 | Kim et al. | 312/402 |
| 2012/0074825 | A1* | 3/2012 | Armstrong et al. | 312/334.23 |
| 2013/0278126 | A1* | 10/2013 | Jang et al. | 312/404 |

OTHER PUBLICATIONS

Written Opinion issued in Application No. PCT/US2012/033025 dated Mar. 6, 2013.

Translation of Notification of the First Office Action in Chinese Patent Application No. 201280026540.6, dated Mar. 30, 2015.

* cited by examiner

CRISPER DRAWERS WITH ROLLERS AND RAMP

BACKGROUND OF THE INVENTION

The present invention relates generally to a crisper drawer for refrigerators. In particular, the invention relates to a crisper drawer including a crisper pan which is self-closing.

A refrigerator is an electrical appliance in which a refrigerating cycle of compression, condensation, expansion, and evaporation is repeated using refrigerant to store food at a low temperature. Generally, refrigerators are adapted to store various foods at a low temperature, in a fresh state, in freezing and refrigerating compartments defined in a refrigerator body, by circulating cold air in the freezing and refrigerating compartments. In the freezing compartment, food such as meat or ice cream, to be maintained at a temperature not higher than a freezing temperature thereof, is stored. On the other hand, food such as vegetables or beverages, to be maintained at a temperature slightly higher than the freezing temperature thereof, is stored in the refrigerating compartment or within temperature controlled storage containers within the refrigeration compartment. Thus, the recent tendency to equip refrigerators with storage containers has led to an increase in overall size of the refrigerator.

As large refrigerators are becoming more common, various types of refrigerators have been developed to satisfy the ever-increasing demands of the user. For example, a top refrigerator type is known in which a fresh food compartment is located above a freezing compartment and a side-by-side type refrigerator is known in which a freezing compartment and a fresh food compartment are positioned left and right of one another. A bottom refrigerator type is also known in which a fresh food compartment is located below a freezing compartment.

The bottom mount refrigerator concept is gaining in popularity because it provides easier access to the fresh food compartment in comparison with current side-by-side and top-mount refrigerators. The bottom mount refrigerator also has a better ergonomic position to store food and does not have as many hidden compartments.

Current bottom mount refrigerators have full-width storage compartments, which are popular with consumers. Each of the storage compartments has a crisper drawer mounted therein. Conventional crisper drawers have ball bearing drawer glides. However, these ball bearing drawer glides are more expensive. Also, it is desirable to provide each of the crisper drawers with a self-closing function so that the user does not have to close the drawer completely.

Thus, what is needed is a crisper drawer that is less expensive than the conventional crisper drawers and has a self-closing function.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a crisper drawer for a refrigerator having a storage compartment is provided. The crisper drawer is mounted within the storage compartment. The crisper drawer comprises a crisper pan for storing at least one item and a shelf for supporting the crisper pan. The crisper pan is movable relative to the storage compartment, while the shelf is fixed to the storage compartment. The crisper pan comprises a pair of pan rear rollers and a pair of pan rolling surfaces. Each of the pan rolling surfaces comprises a ramp portion. On the other hand, the shelf comprises a pair of shelf rolling surfaces formed on the shelf, and a pair of fixed shelf rollers mounted on the shelf. Each of the pair of the fixed shelf rollers is rollable on each of the pan rolling surfaces including the ramp portion, and each of the pair of the pan rear rollers is rollable on each of the shelf rolling surfaces.

In accordance with another aspect of the present invention, a refrigerator comprising a cabinet shell and a crisper drawer is provided. The cabinet shell has defined therein a storage compartment. The crisper drawer is mounted within the storage compartment. The crisper drawer comprises a crisper pan for storing at least one item and a shelf for supporting the crisper pan. The crisper pan is movable relative to the storage compartment, while the shelf is fixed to the storage compartment. The crisper pan comprises a pair of pan rear rollers and a pair of pan rolling surfaces. Each of the pan rolling surfaces comprises a ramp portion. On the other hand, the shelf comprises a pair of shelf rolling surfaces formed on the shelf, and a pair of fixed shelf rollers mounted on the shelf. Each of the pair of the fixed shelf rollers is rollable on each of the pan rolling surfaces including the ramp portion, and each of the pair of the pan rear rollers is rollable on each of the shelf rolling surfaces.

It is one object of the present invention to provide a self-closing crisper drawer for a refrigerator. As the user pushes the crisper drawer to close it, both the fixed shelf rollers and the rear pan rollers roll on the rolling surfaces. When each of the shelf rollers reaches a ramp portion, the crisper drawer is self-closed without the user's pushing operation.

It is another object of the present invention to provide a crisper drawer that is less expensive than the conventional crisper drawers having ball bearing drawer glides.

BRIEF DESCRIPTION OF THE DRAWINGS

The foregoing and other aspects of the present invention will become apparent to those skilled in the art to which the present invention relates upon reading the following description with reference to the accompanying drawings, in which.

Wherever the same component appears in more than one figure of the drawings, it is identified in all the figures in which it appears by the same reference numeral.

DETAILED DESCRIPTION OF AN EMBODIMENT OF THE INVENTION

Figure 1:
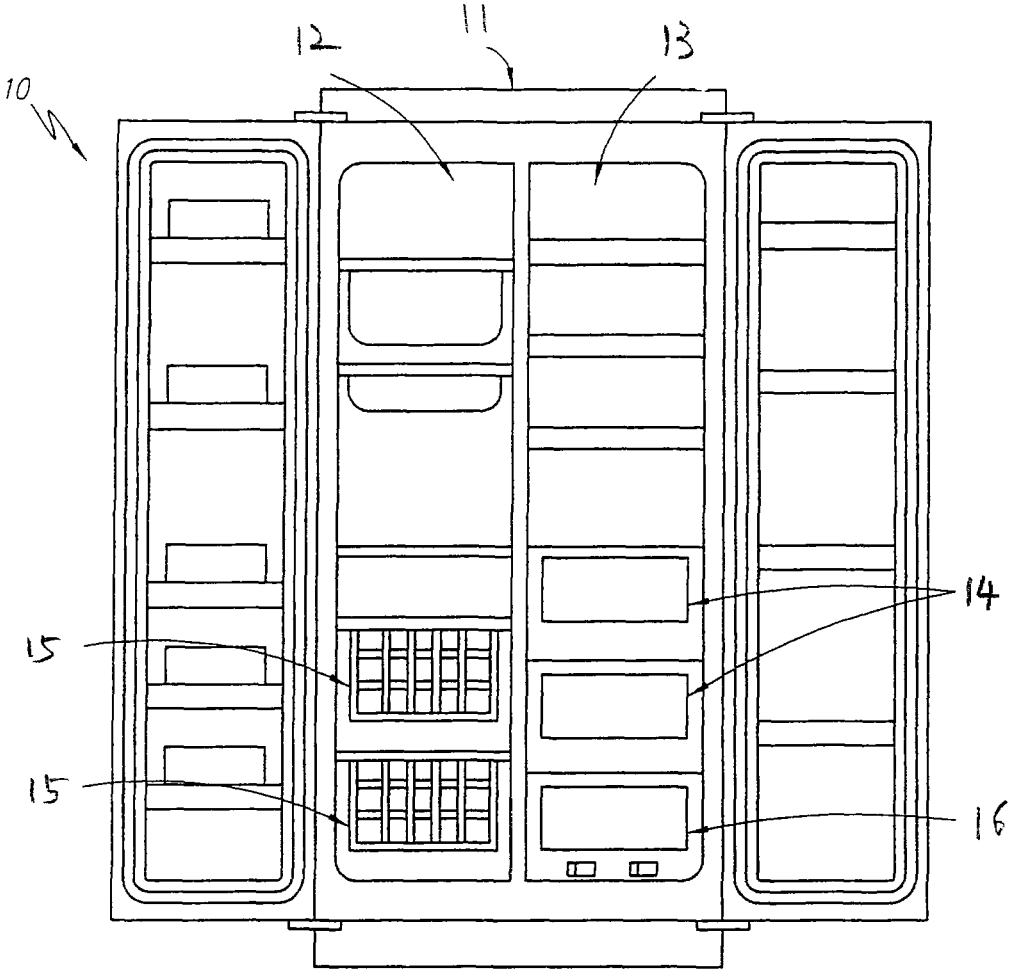
FIG. 1 is a front view of a refrigerator that includes a crisper drawer of the present invention.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Referring to the drawings, FIG. 1 shows a typical household refrigerator, indicated generally at 10. The refrigerator includes a storage compartment 11 that can be used to store objects for cooling. The storage compartment 11 can include a freezer compartment 12 and a refrigerator compartment 13. The fresh food and freezer compartments can include closed drawers 14 and basket-like drawers 15 for storing articles of food and the like. The variety of drawers 14, 16 or baskets 15 in at least one of the compartments 12, 13 can be used to store various items, such as food items.

Figure 2:
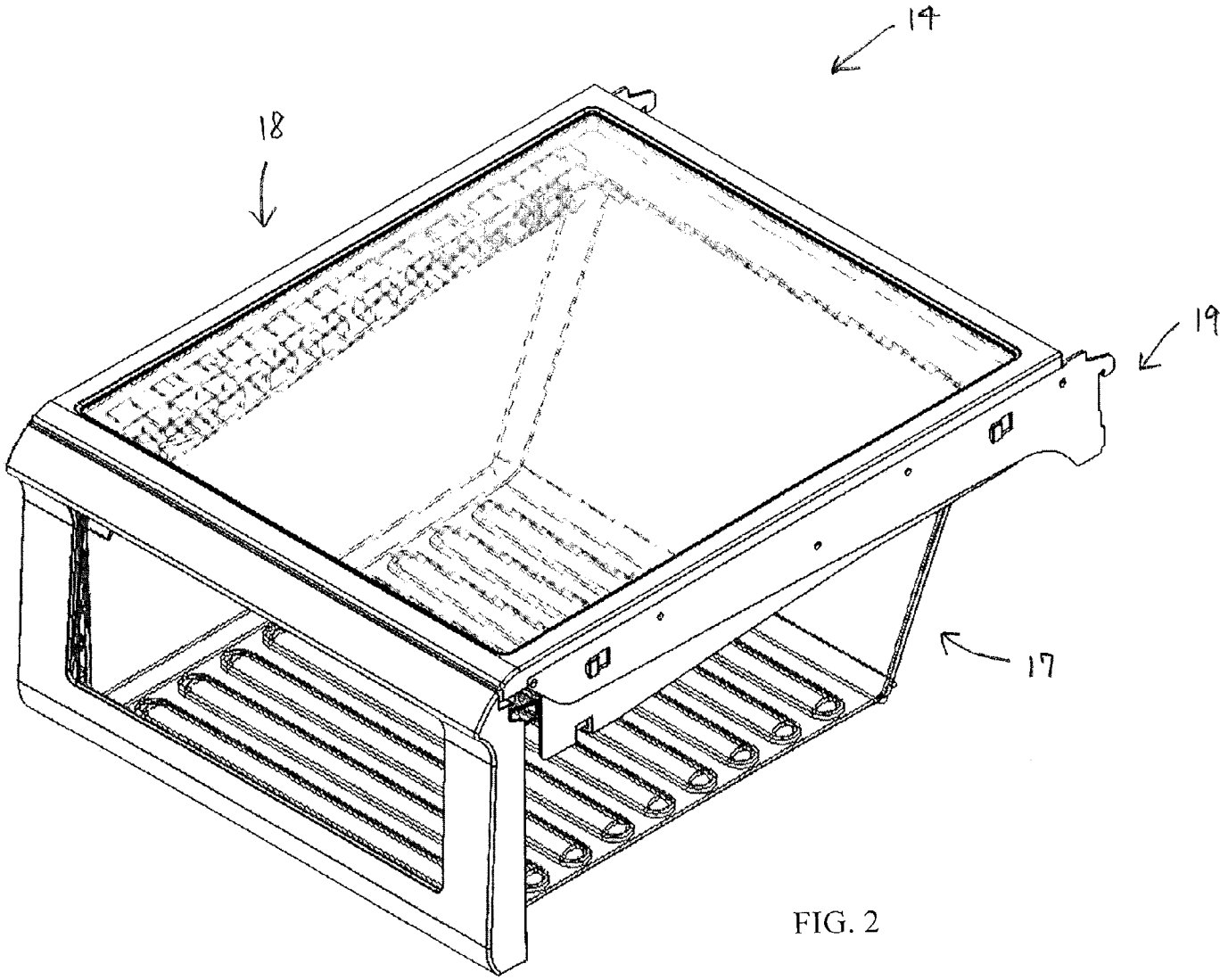
FIG. 2 is a perspective view of the crisper drawer of FIG. 1 including a crisper pan and a shelf for supporting the crisper pan.

An example of the crisper drawer 14 of the subject invention that is used in the refrigerator of FIG. 1 is shown in FIG. 2. The crisper drawer 14 includes a crisper pan 17 and a shelf 18. The crisper pan 17 may be used to store various items, such as food items. The shelf 18, which is fixed to the storage compartment 11, supports the crisper pan 17 with the rolling surfaces and the rollers rolled on the rolling surfaces. The shelf 18 may include a cover 19 which covers the side surfaces of the crisper pan 17.

Figure 3:
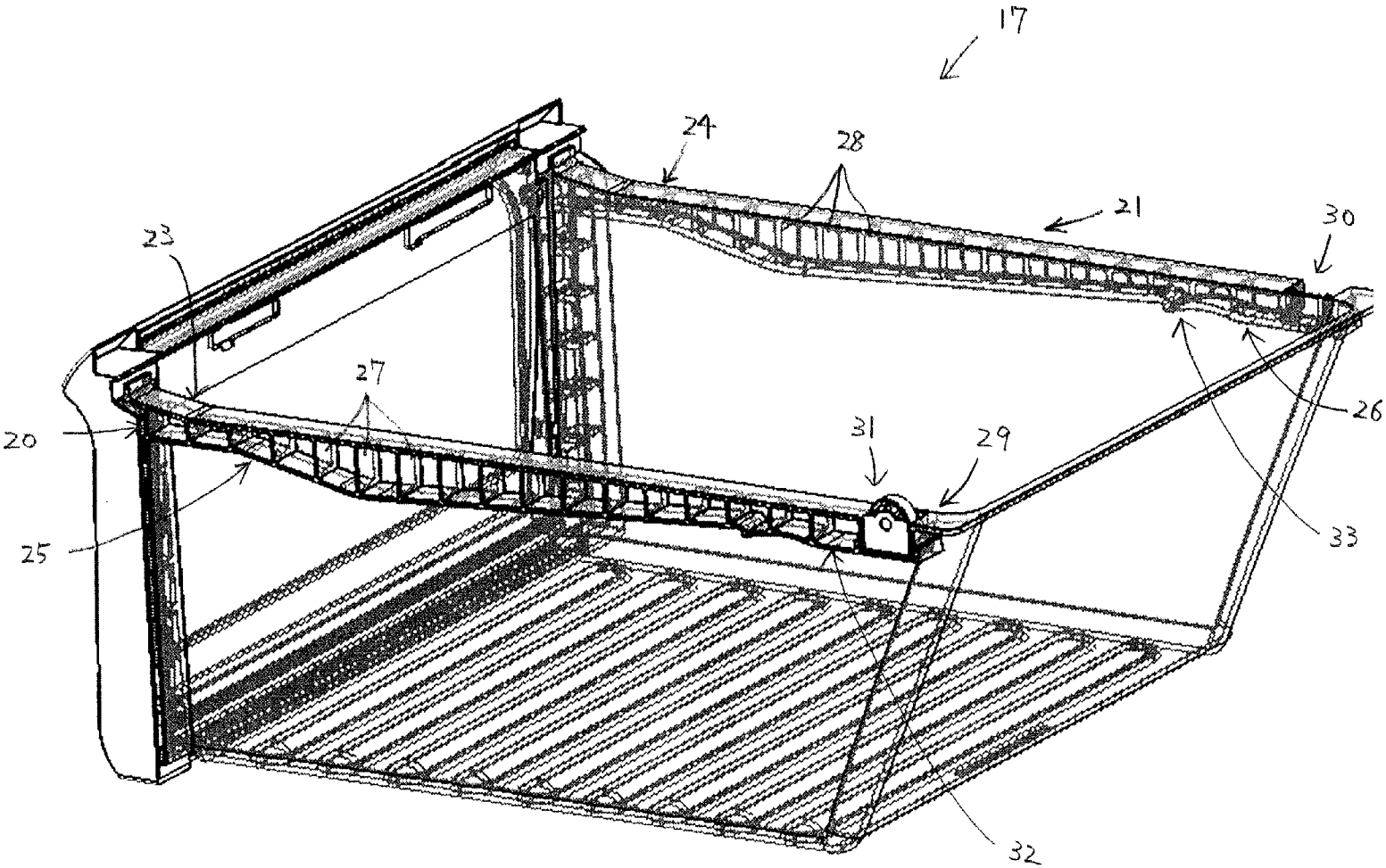
FIG. 3 is a perspective view of the crisper pan of FIG. 2 with a pair of pan rear rollers and a pair of pan rolling surfaces each having a ramp portion.

As shown in FIG. 3 which is a perspective view of the crisper pan 17, the crisper pan 17 includes opposing beams 20, 21. The opposing beams 20, 21 are formed on the upper sections of the side plates of the crisper pan 17. The beam 20 is comprised of a top plate 23, a bottom plate 25, and a plurality of bridging plates 27 vertically extending from the bottom surface of the top plate 23 to the top surface of the bottom plate 25. Also, another beam 21 is comprised of a top plate 24, a bottom plate 26, and a plurality of bridging plates 28 vertically extending from the bottom surface of the top plate 24 to the top surface of the bottom plate 26. The bridging plates 27 may be formed at substantially the same interval from one end of the beam 20 to the other end of the beam 20. Also, the bridging plates 28 may be formed at substantially the same interval from one end of the beam 21 to the other end of the beam 21. Each of the bridging plates 27 may be attached to the bottom surface of the top plate 23 at substantially a right angle. Also, each of the bridging plates 28 may be attached to the bottom surface of the top plate 24 at substantially a right angle. The beam 20 has a pocket portion 29 formed in the vicinity of one end of the beam 20. Also, another beam 21 has a pocket portion 30 formed in the vicinity of one end of the beam 21. The pocket portions 29, 30 are portions of the beams 20, 21 having thinned width, respectively in order to place a pair of pan rear rollers therein. The pair of pan rear rollers (only one roller 31 is shown in FIG. 3) are inserted into the pocket portions 29, 30 of the beams 20, 21, respectively. These pan rear rollers may be located at a higher position than the top surface of the beams 20, 21 so that they can roll smoothly. The bottom surfaces of the bottom plates 25, 26 constitute pan rolling surfaces 32, 33.

Figure 4:
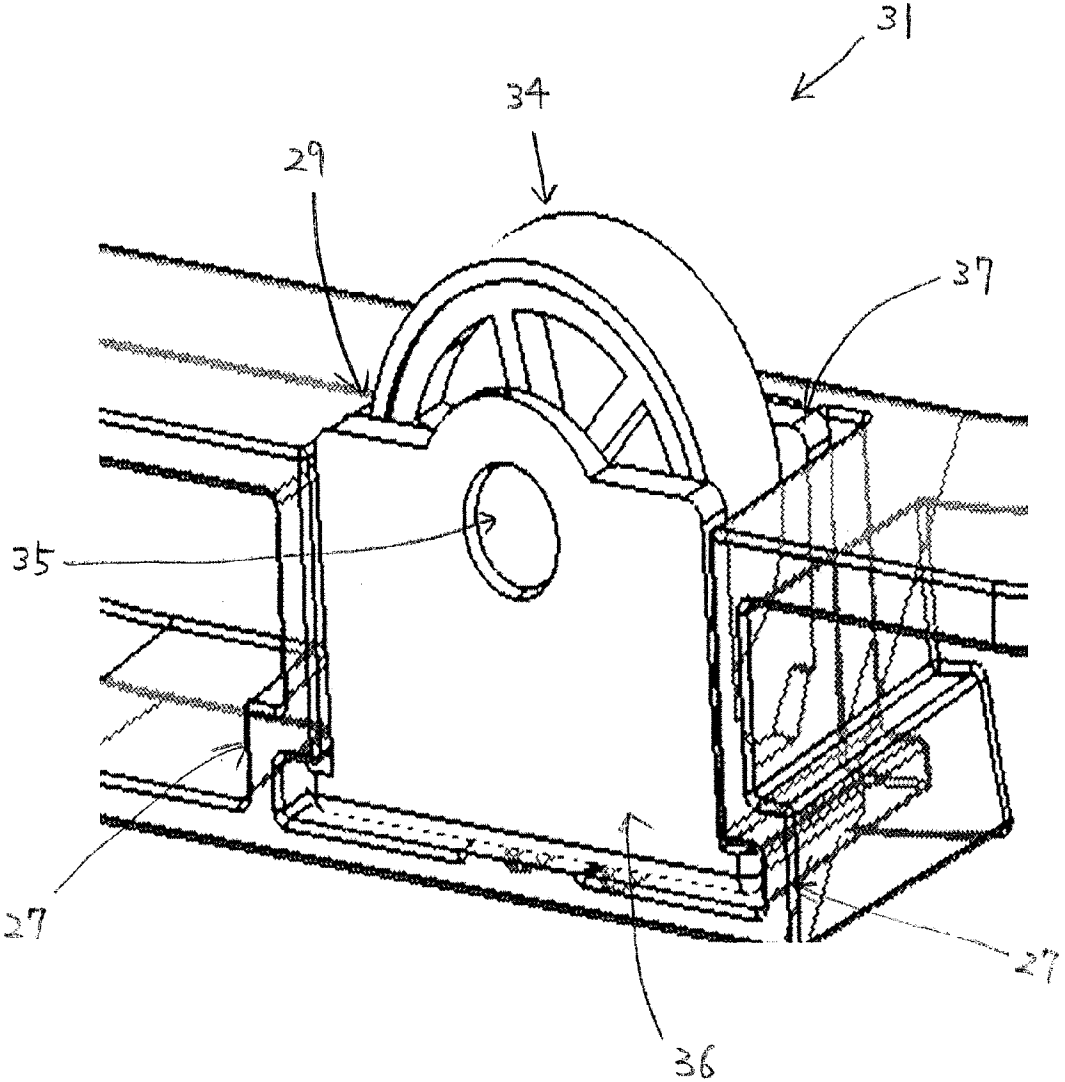
FIG. 4 is an enlarged view of one of the pan rear rollers of the crisper pan of FIG. 3.

FIG. 4 shows the pan rear roller 31 in an enlarged view. The pan rear roller 31 includes a wheel 34, a pin 35 inserted in the center hole of the wheel 34, and a pair of sockets 36, 37 supporting the pin 35. Another pan rear roller (not shown) also includes components corresponding to the wheel 34, the pin 35, and the pair of sockets 36, 37. The pair of sockets 36, 37 are fixed in the pocket portion 29. As shown in FIG. 3, the side walls of the pocket portion 29 are constituted by two bridging plates 27, 27, and the side walls of the pocket portion 30 are constituted by two bridging plates 28, 28. The distance between the bridging plates 27, 27 which constitute the side walls of the pocket portion 29 may be widened at the bottom so that the sockets 36, 37 can fixedly be placed in the widened space. The bridging plates 28, 28 which constitute the pocket portion 30 have the same type of the widened portion. The pin 35 not only serves to retain the wheel 34 within the concave-shaped pocket portion 29, but also provides a bearing or axle surface so that the wheel 34 can rotate freely. The pair of sockets 36, 37 not only support the pin 35, but also helps the wheel 34 rotate smoothly around the pin 35.

Figure 5:
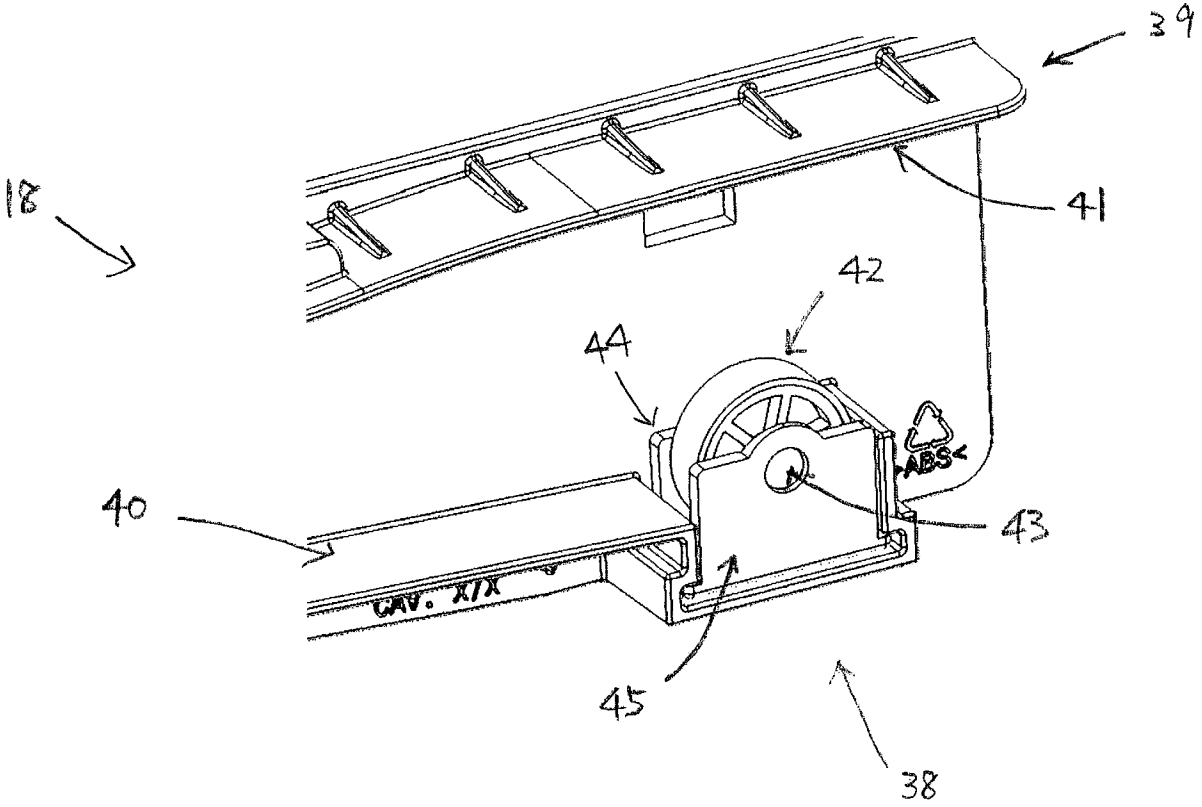
FIG. 5 is an enlarged view of one of the fixed shelf rollers mounted on the shelf of FIG. 2.

On the other hand, FIG. 5 shows the fixed shelf roller 38 in an enlarged view. The shelf 18 includes a pair of upper rails 39, 39 and lower rails 40, 40 (Only one upper rail 39 of the pair of the upper rails and one lower rail 40 of the pair of the lower rails are shown in FIG. 5). Each of the upper rails 39, 39 is opposed to each of the lower rails 40, 40. Each of the upper rails 39, 39 has a shelf rolling surface 41 on which each of the pair of the pan rear rollers is rollable, as is explained below. Between each of the upper rails 39, 39 and each of the lower rails 40, 40, there is a channel into which each of the beams 20, 21 is inserted. The fixed shelf roller 38 is positioned on the end portion of one lower rail 40 of the shelf 18. Another fixed shelf roller (not shown) corresponding to the fixed shelf roller 38 is also positioned on the end portion of another lower rail (not shown) corresponding to the lower rail 40. As shown in FIG. 5, the end of the lower rail 40 is formed as a concave shape so that the fixed shelf roller 38 is inserted in the concave shape. The concave shaped my be formed by bending the end portion of the lower rails 40. Just like the pan rear roller 31, the fixed shelf roller 38 includes a wheel 42, a pin 43 inserted in the center hole of the wheel 42, and a pair of sockets 44, 45 supporting the pin 43. Another fixed shelf roller (not shown) also includes components corresponding to the wheel 42, the pin 43, and the pair of sockets 44, 45. The end portion of the lower rail 40 which constitutes the side wall of the concave shape may not be as high as the wheel 42 in order to help the wheel 42 rotate smoothly. As with the pan rear roller 31, the bottom of the concave shaped lower rail 40 may be widened so that the sockets 44, 45 can fixedly be placed in the widened portion.

Figure 6:
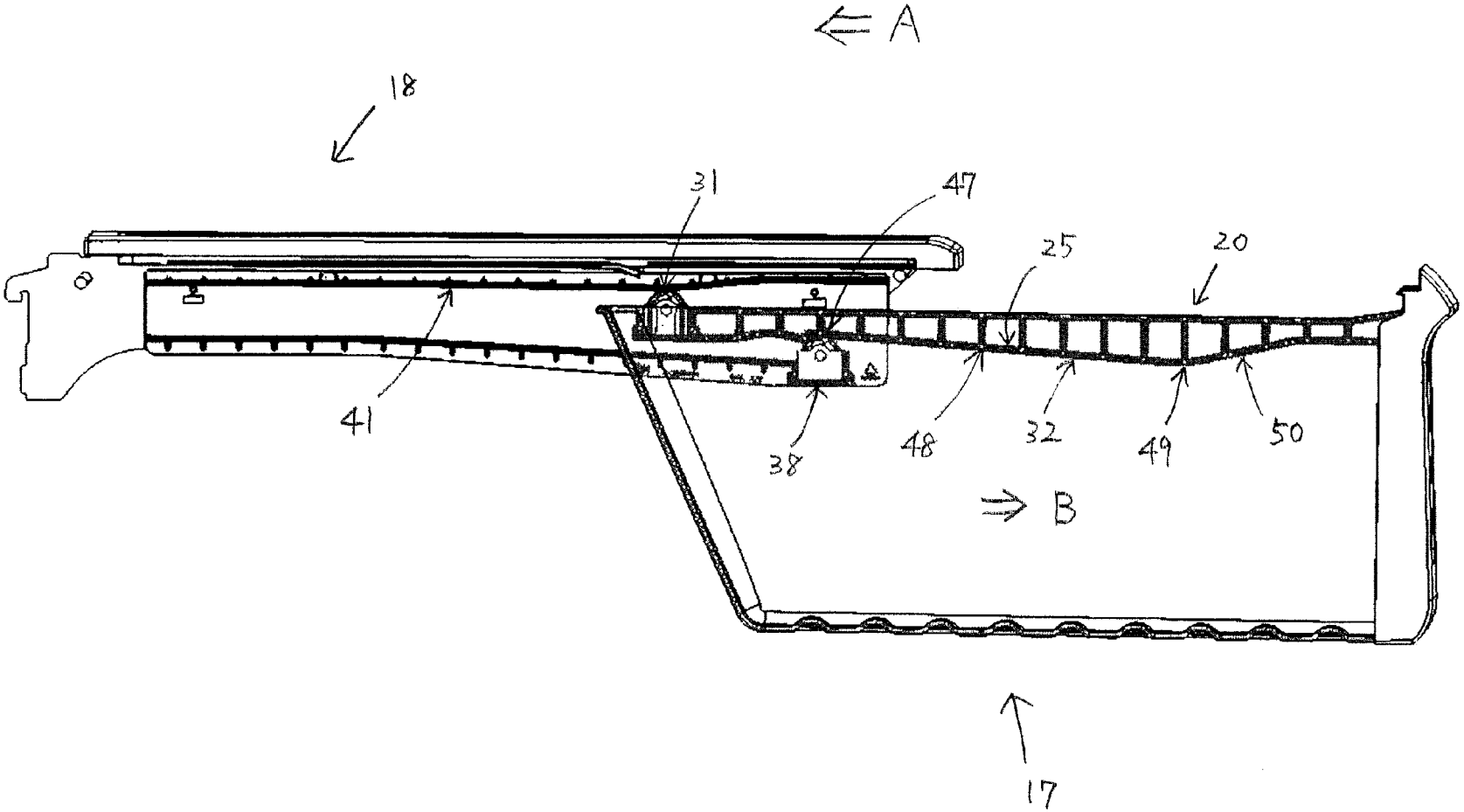
FIG. 6 is a sectional view of the crisper pan and the shelf of FIG. 2 in an opened position.
Figure 7:
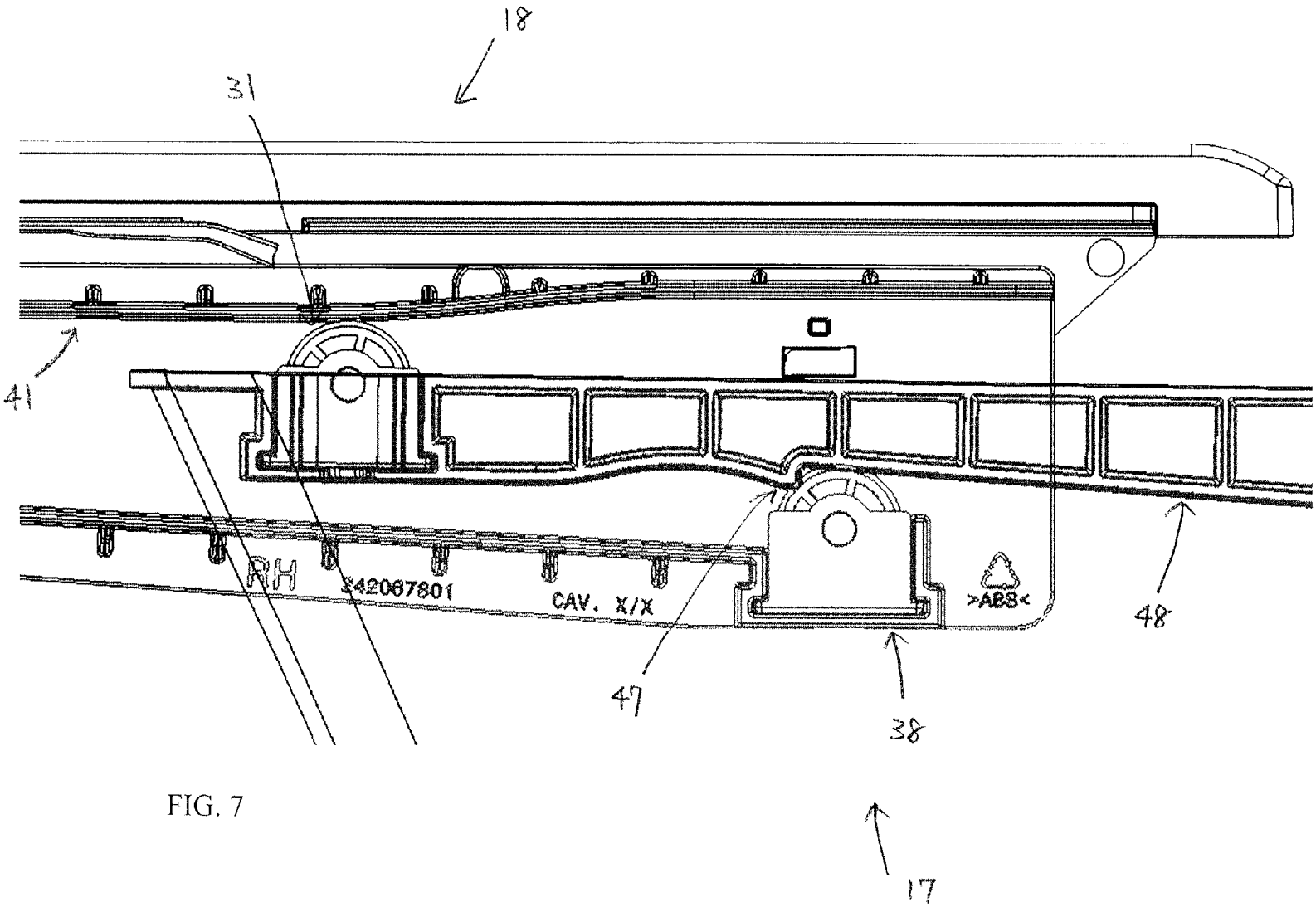
FIG. 7 is an enlarged view of the crisper pan and the shelf of FIG. 6 in which one of the fixed shelf rollers is stopped at a stop feature formed in one of the pan rolling surfaces.

FIGS. 6 and 7 are the sectional views of the crisper pan 17 and the shelf 18 in an opened position. In the opened position, the fixed shelf roller 38 is stopped from moving further toward the rear portion of the crisper pan 17 (a direction A) by a stop feature 47 formed on the bottom plate 25 of the beam 20. Another fixed shelf roller (not shown) corresponding to the fixed shelf roller 38 is also stopped from moving further toward the rear portion of the crisper pan 17 (a direction A) by another stop feature (not shown) on the bottom plate 26 of the beam 21. The stop feature 47 and the corresponding stop feature may be anywhere on the bottom plate 25 of the beam 20, depending upon the desired degree of opening the crisper pan 17. On the other hand, the pan rear roller 31 is located on the shelf rolling surface 41. Another pan rear roller (not shown) corresponding to the pan rear roller 31 is also located on another shelf rolling surface corresponding to the shelf rolling surface 41. When the fixed shelf roller 38 is stopped at the stop feature 47, the pan rear roller 31 is also stopped somewhere on the shelf rolling surface 41. Another fixed shelf roller (not shown) acts in the same way. The bottom plates 25 of the beam 20 has a gradual slope portion 48 which starts from the vicinity of the stop feature 47 and ends at a peak portion 49 which is distanced apart from the front portion of the crisper pan 17. Another gradual slope portion (not shown) is formed on the bottom plate 26 of the beam 21 in the same way. It is preferred that both of the gradual slope portions are formed at substantially the same position to each other so that the fixed shelf rollers and the pan rear rollers can roll smoothly on the pan rolling surfaces and the shelf rolling surfaces, respectively. When the user pushes the front portion of the crisper pan 17 in the direction A, the fixed shelf roller 38 starts rolling on the gradual slope portion 48 of the pan rolling surface 32 in the direction B. Another fixed shelf roller (not shown) also starts rolling on the corresponding gradual slope portion of another pan rolling surface 33 in the direction B in the same way. Because both of the gradual slope portions are not very steep, the users do not need to push hard in order to move the fixed shelf rollers. On the other hand, the rear pan roller 31 starts rolling on the shelf rolling surface 41 in the direction B. Another rear pan roller (not shown) corresponding to the rear pan roller 31 start rolling on another shelf rolling surface (not shown) corresponding to the shelf rolling surface 41 in the direction B in the same way.

Figure 8:
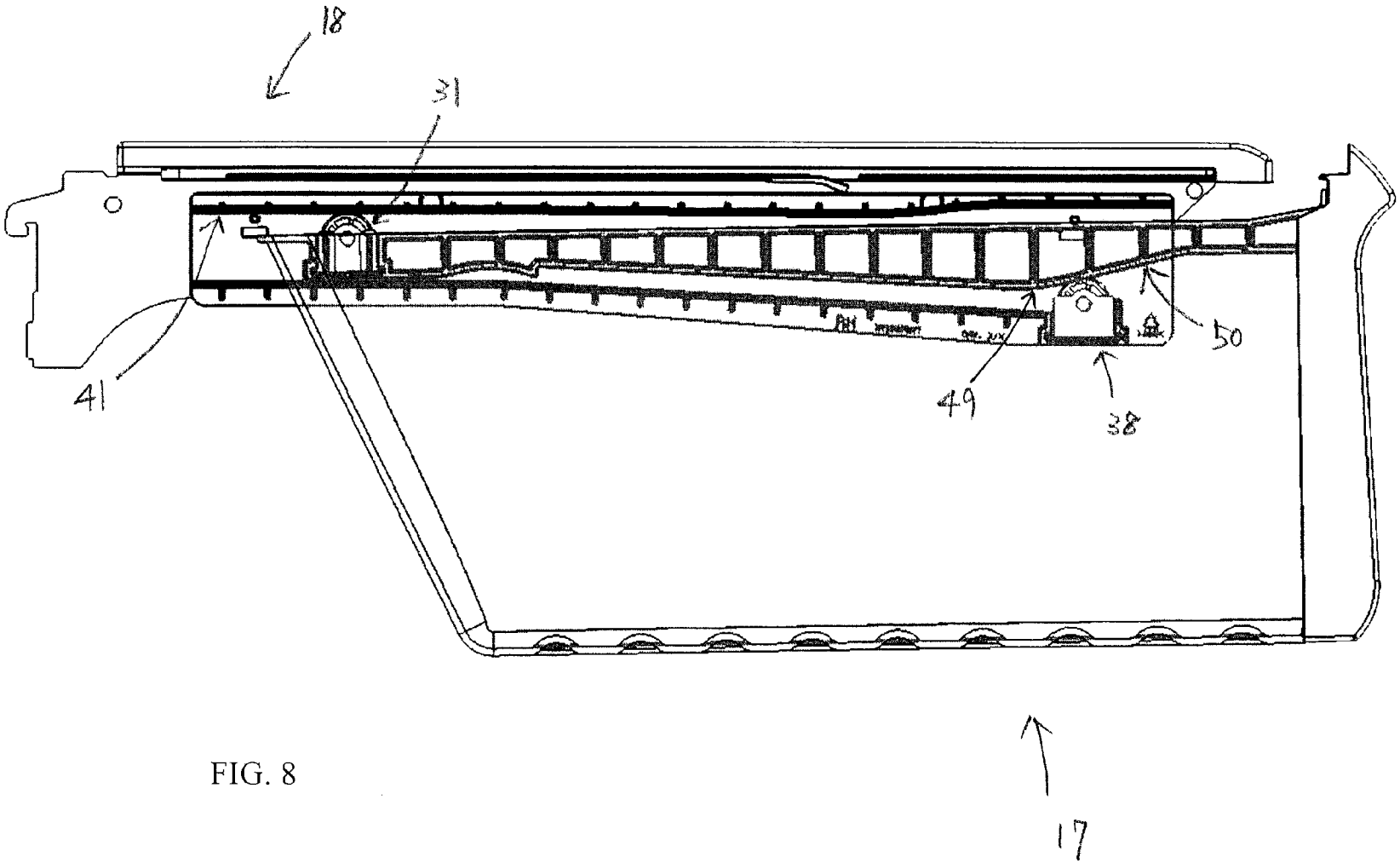
FIG. 8 is a sectional view of the crisper pan and the shelf of FIG. 2 in a near closed position.
Figure 9:
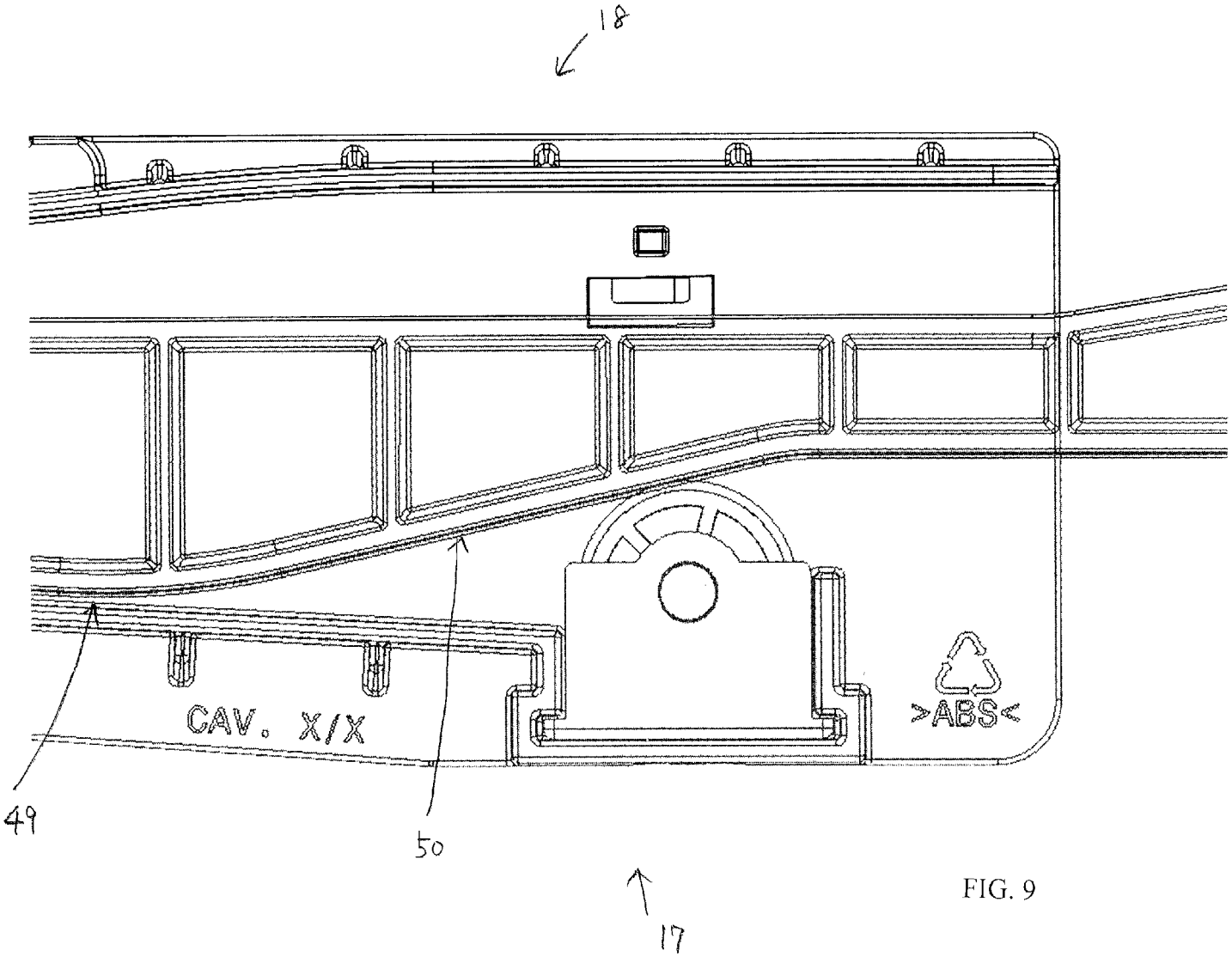
FIG. 9 is an enlarged view of the crisper pan and the shelf of FIG. 8 in which one of the fixed shelf rollers is rolling on the ramp portion formed in one of the pan rolling surfaces.

When the fixed shelf roller 38 reaches past the peak portion 49, they start rolling a ramp portion 50 formed on the pan rolling surface 32. At that time, the end portion of the shelf 18 may preferably be located at about 2-½ inches from the front portion of the crisper pan 17. The corresponding fixed shelf roller (not shown) rolls in the same way as the fixed shelf roller 38 rolls on the pan rolling surface 32. FIGS. 8 and 9 are the sectional views of the crisper pan 17 and the shelf 18 in a near closed position where the fixed shelf roller 38 is rolled past the peak portion 49 and on the ramp portion 50. Since the ramp portion 50 is a steep surface, the fixed shelf roller 38 rolls on the ramp portion 50 without adding any force by the user (i.e., self-rolling). Thus, the crisper pan 17 is self-closed onto the shelf 18. The ramp portion 50 and the corresponding ramp portion may be located at a position of 1 to 4 inches from the front portion of the crisper pan 17. However, the location of the ramp portion 50 at a position greater than 3.5 inches from the front portion of the pan 17 may not work very well on the self closing feature. Each of the ramp portion 50 and the corresponding ramp portion may preferably be sloped at an angle of 12 to 13 degrees, more preferably 12.8 degrees to each of the top surfaces of the opposing beams 20, 21. The angle of the ramp portion 50 is generally greater than the angle of the gradual slope portion 48. Additionally, if the user were to pull the front portion of the closed crisper pan 17 in the direction B such as to open the crisper pan 17 from the shelf 18, the fixed shelf roller 38 would start rolling on the ramp portion 50 of the pan rolling surface 32 in the direction A. As is shown in FIG. 6, when the fixed shelf roller 38 would be rolled past the peak portion 49 and on the gradual slope portion 48, since the gradual slope portion 48 is gradually sloped, the fixed shelf roller 38 would roll on the gradual slope portion 48 without adding any force by the user (i.e., self-rolling), thereby self-expanding the opening of the crisper pan 17 from the shelf 18 until the fixed shelf roller 38 reached the stop feature 47.

After the fixed shelf roller 38 rolls past the end of the ramp portion 50, the fixed shelf roller 38 still keeps rolling until it reaches near the end of the pan rolling surface 32 because of the potential energy generated from the steepness of the ramp portion 50. The corresponding fixed shelf roller (not shown) rolls in the same way as the fixed shelf roller 38. When the fixed shelf roller 38 and the corresponding fixed shelf roller (not shown) rest on the prescribed position, the crisper pan 17 is completely closed with the crisper shelf 18.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A crisper drawer for a refrigerator having a storage compartment, wherein the crisper drawer is mountable within the storage compartment, the crisper drawer comprising:

a crisper pan for storing at least one item, wherein the crisper pan is movable relative to the storage compartment and comprises a pair of pan rear rollers, a pair of beams formed on an upper portion of the crisper pan and a pair of pan rolling surfaces, wherein each of the beams comprises a top plate forming the upper portion of the crisper pan, a bottom plate located under the top plate and opposing to the top plate, and a plurality of bridging plates connecting the top plate to the bottom plate, and wherein each of the pan rolling surfaces is formed on the bottom plate of each of the beams, and the bottom plate comprises a gradual slope portion and a ramp portion, the gradual slope portion and the ramp portion both sloping downward to define a peak portion protruding downwardly from the top plate, the peak portion defining a point between which the ramp portion self-closes the storage compartment and the gradual slope portion self-expands an opening of the storage compartment; and a shelf for supporting the crisper pan, wherein the shelf is fixable to the storage compartment and comprises a pair of shelf rolling surfaces formed on the shelf, and a pair of fixed shelf rollers mounted on the shelf, wherein each of the pair of the fixed shelf rollers is rollable on each of the pan rolling surfaces, and each of the pair of the pan rear rollers is rollable on each of the shelf rolling surfaces, and wherein each of the beams comprises a pocket portion having a thinned width, side walls of each of the pocket portions are constituted by two of the bridging plates, and each of the pan rear rollers is inserted into each of the pocket portions.

2. The crisper drawer of claim 1, wherein the shelf comprises a pair of upper rails and lower rails mounted on side surfaces of the shelf, wherein each of the pan rolling surfaces is formed on each of the upper rails.

3. The crisper drawer of claim 2, wherein each of the fixed shelf rollers is mounted on an end portion of each of the lower rails.

4. The crisper drawer of claim 1, wherein each of the pan rear rollers is mounted on an end portion of each of the beams.

5. The crisper drawer of claim 1, wherein the ramp portion is sloped at an angle of from 12 to 13 degrees to a top surface of each of the beams.

6. The crisper drawer of claim 1, wherein the ramp portion extends from 1 to 4 inches from an end portion of each of the beams.

7. The crisper drawer of claim 1, wherein the ramp portion extends from 1 to 3.5 inches from an end portion of each of the beams.

8. The crisper drawer of claim 1, wherein the bottom plate further comprises a stop feature for preventing each of the pair of the fixed shelf rollers from rolling beyond the stop feature.

9. The crisper drawer of claim 8, wherein the stop feature is a protrusion formed on the bottom plate.

10. A refrigerator, comprising:

a cabinet shell having defined therein a storage compartment; and a crisper drawer mounted within the storage compartment, the crisper drawer comprising:

a crisper pan for storing at least one item, wherein the crisper pan is movable relative to the storage compartment and comprises a pair of pan rear rollers, a pair of beams formed on an upper portion of the crisper pan and a pair of pan rolling surfaces, wherein each of the beams comprises a top plate forming the upper portion of the crisper pan, a bottom plate located under the top plate and opposing to the top plate, and a plurality of bridging plates connecting the top plate to the bottom plate, and wherein each of the pan rolling surfaces is formed on the bottom plate of each of the beams, and the bottom plate comprises a gradual slope portion and a ramp portion, the gradual slope portion and the ramp portion both sloping downward to define a peak portion protruding downwardly from the top plate, the peak portion defining a point between which the ramp portion self-closes the storage compartment and the gradual slope portion self-expands an opening of the storage compartment; and a shelf for supporting the crisper pan, wherein the shelf is fixed to the storage compartment and comprises a pair of shelf rolling surfaces formed on the shelf, and a pair of fixed shelf rollers mounted on the shelf, wherein each of the pair of the fixed shelf rollers is rollable on each of the pan rolling surfaces , and each of the pair of the pan rear rollers is rollable on each of the shelf rolling surfaces, and wherein each of the beams comprises a pocket portion having a thinned width, side walls of each of the pocket portions are constituted by two of the bridging plates, and each of the pan rear rollers is inserted into each of the pocket portions.

11. The refrigerator of claim 10, wherein the shelf comprises a pair of upper rails and lower rails mounted on side surfaces of the shelf, wherein each of the pan rolling surfaces is formed on each of the upper rails.

12. The refrigerator of claim 11, wherein each of the fixed shelf rollers is mounted on an end portion of each of the lower rails.

13. The refrigerator of claim 10, wherein each of the pan rear rollers is mounted on an end portion of each of the beams.

14. The refrigerator of claim 10, wherein the ramp portion is sloped at an angle of from 12 to 13 degrees to a top surface of each of the beams.

15. The refrigerator of claim 10, wherein the ramp portion extends from 1 to 4 inches from an end portion of each of the beams.

16. The refrigerator of claim 10, wherein the ramp portion extends from 1 to 3.5 inches from an end portion of each of the beams.

17. The refrigerator of claim 10, wherein the bottom plate further comprises a stop feature for preventing each of the pair of the fixed shelf rollers from rolling beyond the stop feature.

18. The refrigerator of claim 17, wherein the stop feature is a protrusion formed on the bottom plate.

* * * * *